US005439602A

United States Patent [19]

Eckard et al.

[11] Patent Number: 5,439,602

[45] Date of Patent: Aug. 8, 1995

[54] OVERBASED SULFONATES COMBINED WITH PETROLEUM OXIDATES FOR METAL FORMING

[75] Inventors: Alan D. Eckard, Chester, N.Y.; Igor Riff, Chatham, N.J.

[73] Assignee: Witco Corporaton, Greenwich, Conn.

[21] Appl. No.: 271,153

[22] Filed: Jul. 6, 1994

[51] Int. Cl.[6] ..... C10M 107/02

[52] U.S. Cl. ..... 252/18; 252/33

[58] Field of Search ..... 252/18

[56] References Cited

U.S. PATENT DOCUMENTS

| | | | |
|---|---|---|---|
| 4,089,689 | 5/1978 | Rigdon et al. | 252/39 |
| 4,261,840 | 4/1981 | Gragson | 252/33.4 |
| 4,368,130 | 1/1983 | Gragson | 252/33.4 |
| 4,505,830 | 3/1985 | Vinci | 252/33 |
| 4,659,488 | 4/1987 | Vinci | 252/33 |
| 5,013,463 | 5/1991 | Slama | 252/18 |

*Primary Examiner*—Ellen M. McAvoy

*Attorney, Agent, or Firm*—Scully, Scott, Murphy & Presser

[57] ABSTRACT

Compositions of matter comprising petroleum oxidate having a total acid number no greater than 35, and overbased calcium sulfonate having a total base number of at least about 150 and a strong total base number less than 10, which are free of or contain no more than trace amounts of carboxylic acids containing 8 or fewer carbon acids, are oil-soluble, non-gelling, and useful in metalworking compositions imparting lubricity and corrosion protection.

39 Claims, No Drawings

OVERBASED SULFONATES COMBINED WITH PETROLEUM OXIDATES FOR METAL FORMING

BACKGROUND OF THE INVENTION

This invention relates to metal working operations and more particularly to lubricants for use during such operations. In its broadest sense, it comprises compositions and methods for lubricating metal during working thereof and metal workpieces having on the surface thereof a film of a lubricant composition.

Particularly in the case of galvanized steel which is being widely used for metal forming of automotive body component, conventional overbased sulfonates can provide a high degree of lubricity for drawing and forming operations. Many automotive plants are moving towards the use of pre-lubrication of sheet metal which requires that both the anti-stain and anti-corrosion components as well as the lubricity additives be combined and applied at the steel mill. Pre lubricants are required to provide high levels of corrosion protection and lubrication in a low viscosity easily cleaned oil base.

The current practices using galvanized steel for automotive applications include the use of both mill oils to prevent corrosion and staining, and drawing compounds to improve drawability. The prelube concept is to provide corrosion protection and the required lubricity for the metal forming operations. Thus, substituting a lubricant for both mill oil and drawing compound would be useful and efficient.

It is of critical importance that stain and corrosion protection be provided for the galvanized surface, because even the slightest corrosion of the zinc will cause cosmetic defects which become evident after final paint application. Once the paint has been applied and cured on a defect-free galvanized surface, the zinc provides the necessary rust protection for the steel substrate.

This increasing attention to the corrosion resistance of vehicles has led to extensive use of two sided electrogalvanized steel. However, only limited work on drawing lubricants for electrogalvanized steel has been done. In recent work, electrogalvanized steel sheet was drawn into a cylindrical cup using various lubricants. Among extreme-pressure agents, the effectiveness of chlorinated paraffin was prominent as well as calcium overbased sulfonate. Chlorinated paraffin has been widely used for drawing sheet steel but increasing government regulations may restrict its use in the future.

Up to now it has not been possible to combine overbased calcium sulfonates with oxidate anti-corrosion additives due to reactions which deactivate the sulfonate and which gel or destabilize the mixture.

DISCUSSION OF THE PRIOR ART

Prior efforts at synthesizing metalworking and lubricating compositions have not recognized the particular conditions that, as described herein, have been found to contribute to satisfactory performance while avoiding unwanted side effects such as gel formation, precipitation, or loss of lubricity and or corrosion protection.

U.S. Pat. No. 5,013,463 discloses an overbased petroleum oxidate prepared by carbonating a petroleum oxidate in the presence of an alkali metal or alkaline earth metal base, wherein the petroleum oxidate is made by oxidizing petroleum oil in the presence of a base. In the described process, the carbonation of the base does not occur until after admixture with the petroleum oxidate.

Thus, there remains potential for reactions leading to formation of gel or precipitates.

U.S. Pat. No. 4,089,689 discloses a petroleum oxidate, said to be gel resistant, made by contacting the oxidate with a calcium derivative such as lime to form a calcium oxidate.

U.S. Pat. No. 4,659,488 discloses metalworking lubricants containing lubricating oil, a basic alkaline earth metal salt of at least one acidic organic compound, or a borated complex of said salt; and at least one sulfurization product of an aliphatic, arylaliphatic, or alicyclic olefinic hydrocarbon containing about 3 to about 30 carbon atoms. The presence of the sulfur can lead to other complications or can subject the composition to limitations on its usage due to potential staining or corrosion problems.

U.S. Pat. No. 4,505,830 is another patent disclosing metalworking lubricants, containing a basic alkali metal salt of a petroleum sulfonic acid or a borated complex thereof.

SUMMARY OF THE INVENTION

One aspect of the present invention is an oil-soluble gel-free composition of matter which is the product formed by combining (a) petroleum oxidate having a total acid number no greater than 35 and free of, or containing no more than trace amounts of, carboxylic acids containing 8 or fewer carbon atoms; and (b) overbased calcium sulfonate having a total base number of at least about 200 and a strong total base number less than 10.

Another aspect of the present invention is oil-soluble, gel-free compositions useful for instance as metalworking fluids, containing the aforementioned composition of matter, and containing for instance a lubricating oil.

A further aspect of the present invention is the method of producing metalworking fluids by combining a lubricating oil with the aforementioned composition of matter.

Yet another aspect of the present invention is a method of forming an oil-soluble gel-free fluid useful as a lubricating composition, comprising the steps of combining (a) petroleum oxidate having a total acid number no greater than 35 and free of, or containing no more than trace amounts of, carboxylic acids containing 8 or fewer carbon atoms; and (b) overbased calcium sulfonate having a total base number of at least 200 and a strong total base number less than 10, in amounts such that the weight ratio of component (a) to component (b) is 10:1 to 1:10.

DETAILED DESCRIPTION OF THE INVENTION

The compositions of the present invention are useful as metalworking fluids. They provide lubricity at the metal-metal interface. They also provide protection against oxidation and corrosion to the metal surface, both before and during working thereof. They also do not form gels or precipitates, even upon prolonged standing or upon accelerated aging, even when formulated with other lubricating additives and oils.

Petroleum oxidates useful in this invention include all conventionally known petroleum oxidate products however prepared, provided they satisfy the criteria set forth herein as to total acid number and low molecular weight acid content.

The broad class of petroleum oxidates are well known corrosion preventing additives in petroleum fractions, e.g., lubricating oils, gasoline, diesel oil, kerosene, etc. where the resultant compositions are either utilized as fuels or as protective coatings. The oxidates are a complex mixture of oxygenated compounds comprising acids, alcohols, aldehydes, esters and ketones, the specific chemical compound combination in the oxidates being dependent upon the chemical makeup of the petroleum fraction oxidized and degree of oxidation. Variations in either will result in a different combination of chemical compounds. Accordingly, since petroleum oxidates defy description by structure or by nomenclature, specific oxidates are defined in terms of properties and or method of manufacture.

Without intending to limit the scope of the invention or the scope of petroleum oxidate useful in this invention, for purposes of illustration, one published procedure for producing petroleum oxidate employs topped crude oils obtained from any source, for example, Pennsylvania, Mid-Continent, California, East Texas, Gulf Coast, Venezuela, Borneo and Arabian crude oils. In this method, a crude oil is topped, i.e., distilled to remove therefrom more volatile and light gas oil, and then vacuum-reduced to remove heavy gas oil and light lubricating oil of the SAE-10 and 20 viscosity grade. The vacuum-reduced crude is then propane fractioned to remove additional heavier fractions of lubricating quality hydrocarbons.

Following the propane fractionation step, the overhead oil fraction is solvent-extracted with a selective solvent which will separate the paraffinic hydrocarbons from the polycyclic aromatic type hydrocarbons. This solvent extraction step for the removal of the more highly aromatic compounds can be carried out in accordance with concurrent or countercurrent solvent extraction techniques which are well known in the art.

The resulting solvent-extracted material, before or after the removal of the more aromatic (polycyclic) hydrocarbons, is preferably deoiled. The deoiling can be carried out by any conventional method, e.g., by solvent dewaxing using propane or other known solvents and solvent mixtures such as methylethylketone or methylisobutylketone with benzene at a suitable temperature.

A preferred feed material for the oxidation reaction is a substantially saturated hydrocarbon fraction having at least 40 carbon atoms per molecule, preferably between 40 and 80 carbon atoms per molecule, a refractive index $nD_{20}$of between 1.440 and 1.520, an average molecular weight between 550 and 1300, a viscosity of between 50 and 1400 SUS at 210° F., and a viscosity index, when determinable, of between 50 and 125.

The oxidizing reaction of the petroleum feed material is accomplished by contacting the selected hydrocarbon fraction, such as that hereinbefore described or other suitable feed, under suitable conditions of temperature and pressure with an oxidizing agent such as free oxygen, nitrogen dioxide, nitrogen trioxide, nitrogen pentoxide, acidified chromium oxide and chromates, permanganates, peroxides, such as hydrogen peroxide, and sodium peroxide, nitric acid, air and ozone. Any oxygen-containing material capable of releasing molecular oxygen under the conditions can be used. Air is a preferred oxidizing agent from the standpoint of economy.

Generally, the oxidation reaction is carried out at a temperature in the range from −40° F. to 800° F. When air is used as the oxidizing agent, temperatures in the range of 100° F. to 800° F., preferably 390° F. to 575° F., are generally used, when air is used as the oxidant.

The oxidation reaction can be carried out at subatmospheric, atmospheric or super-atmospheric pressure. The reaction is preferably carried out at a pressure of between about 10 to 100 pounds per square inch absolute depending upon the composition of the oxidizing gas.

The petroleum oxidates useful in the present invention must be treated to ensure that the total acid number (TAN) is no greater than 35, and preferably no greater than 20 and to ensure that the oxidate is free of low molecular weight acids (defined as carboxylic acids with 8 or fewer carbon atoms) or contains no more than trace amounts (less than 0.5 wt. %) of such acids.

The TAN value as employed herein is determined in accordance with ASTM Test No. D-974.

The desired lowering of the TAN, and lowering or elimination of the low molecular weight acid content, can be carried out by stripping off the low molecular weight acids; by neutralization of the acid content with amounts of a suitable strong base such as sodium hydroxide, potassium hydroxide or calcium hydroxide and filtration or by esterification of the acids with an appropriate agent such as a $C_1$–$C_{18}$ alkanol; or by any combination of such techniques.

The overbased calcium sulfonates useful in the present invention can be derived from sulfonic acids represented by the formula $(R^1)_xT(SO_3H)_y$. In this formula, $R^1$ is generally a hydrocarbon or essentially hydrocarbon radical free from acetylenic unsaturation and containing from about 4 to about 60 aliphatic carbon atoms, preferably an aliphatic hydrocarbon radical such as alkyl or isoalkyl. It may also, however, contain substituents or interrupting groups such as those enumerated above provided the essentially hydrocarbon character thereof is retained. In general, any non-carbon atoms present in $R^1$ do not account for more than 10% of the total weight thereof.

The radical T is a cyclic moiety which may be derived from an aromatic hydrocarbon such as benzene, naphthalene, anthracene or biphenyl, or from a heterocyclic compound such as pyridine, indole or isoindole. Ordinarily, T is an aromatic hydrocarbon nucleus, especially a benzene or naphthalene moiety.

The subscript x is at least 1 and is generally 1–3. The subscripts r and y have an average value of about 1–4 per molecule and are generally also 1.

Illustrative sulfonic acids are mahogany sulfonic acids, petroleum sulfonic acids, mono- and polyparaffin-substituted naphthalene sulfonic acids, cetylchlorobenzene sulfonic acids, cetylphenol sulfonic acids, cetylphenol disulfide sulfonic acids, cetyloxycapryl benzene sulfonic acids, dicetylthianthrene sulfonic acids, dilauryl Beta-naphthol sulfonic acids, dicapryl nitronaphthalene sulfonic acids, petroleum naphthene sulfonic acids, postdodecylbenzene sulfonic acids, alkyl benzene sulfonic acids, dialkyl benzene sulfonic acids, "dimer alkylate" sulfonic acids, and the like. These sulfonic acids are well-known in the art and require no further discussion herein.

The commonly employed method for preparing the basic salts involves heating a mineral oil solution of a sulfonic acid with a stoichiometric excess of a calcium neutralizing agent such as the oxide, hydroxide, carbonate, or bicarbonate at a temperature about 50° C. and filtering the resulting mass. The use of a "promoter" in the neutralization step and the incorporation of a large excess of metal likewise is known. Examples of compounds useful as the promoter include phenolic substances such as phenol, naphthol, alkylphenol, thiophenol, sulfurized alkylphenol, and condensation products of formaldehyde with a phenolic substance; alcohols such as methanol, ethanol, 2-propanol, butanol, octyl alcohol, Cellosolve, Carbitol, ethylene glycol, stearyl alcohol, and cyclohexyl alcohol, amines such as aniline, phenylenediamine, phenothamine, phenyl beta-naphthylamine, and dodecylamine. A particularly effective method for preparing the basic salts comprises mixing an acid with an excess of a basic alkaline earth metal neutralizing agent, an alcoholic promoter compound, and a small amount of water and carbonating the mixture at an elevated temperature such as 60°–200° C.

The overbasing process is carried out in the presence of an organic solvent if more fluidity is desired. Such solvents can be for example benzene, toluene, naphtha, petroleum ether, or xylene.

An essential aspect of this invention is that the strong total base number is less than 10, preferably less than 5, whereas the total base number is at least 150, preferably at least 200, and can be as high as 400, up to 500, or even higher.

The total base number is determined in accordance with ASTM Test No. D-4738.

The strong total base number, i.e. the free alkalinity, is lowered by thoroughly carbonating the overbased calcium sulfonate, for instance by bubbling carbon dioxide through a solution or slurry of the sulfonate. Carbonation preferably converts the calcium hydroxide (and oxide) content to no more than trace amounts (less than 0.5 wt. %) and preferably to zero. Adjusting the strong total base number should be carried out prior to mixing the overbased calcium sulfonate component with the petroleum oxidate, to ensure proper control of the alkalinity adjustment and to realize better the desired properties of the composition of matter that is formed.

The compositions of this invention are prepared by combining the petroleum oxidate component and the overbased calcium sulfonate. They can be mixed together "neat", or in a quantity of a lubricating oil. To permit realization of each component's contribution to the composition, the components should be present in amounts relative to each other of 10:1 to 1:10 (by weight), preferably 5:1 to 1:5, and more preferably 2:1 to 1:2.

The present invention encompasses the combination of these two components per se. The present invention also encompasses such combinations in a lubricating oil base, as set forth herein, and optionally in combination with other well-known additives such as other antioxidants, stain inhibitors and other corrosion inhibitors.

Suitable lubricating oils include natural and synthetic oils and mixtures thereof.

Natural oils are often preferred; they include liquid petroleum oils and solvent-treated, acid-treated or hydrotreated mineral lubricating oils of the paraffinic, naphthenic and mixed paraffinic-naphthenic types. Oils of lubricating viscosity derived from coal or shale are also useful base oils.

Synthetic lubricating oils include hydrocarbon oils and halo-substituted hydrocarbon oils such as polymerized and interpolymerized olefins [e.g., polybutylenes, polypropylenes, propylene-isobutylene copolymers, chlorinated polybutylenes, poly(1-hexenes), poly(1-octenes), poly(1-decenes)]; alkylbenzenes [e.g., dodecylbenzenes, tetradecylbenzenes, dinonylbenzenes, di(2-ethylhexyl)benzenes]; polyphenyls (e.g., biphenyls, terphenyls, alkylated polyphenyls); and alkylated diphenyl ethers and alkylated diphenyl sulfides and the derivatives, analogs and homologs thereof.

Another suitable class of synthetic lubricating oils comprises the esters of dicarboxylic acids of low acid number, (e.g., phthalic acid, succinic acid, alkyl succinic acids and alkenyl succinic acids, maleic acid, azelaic acid, suberic acid, sebacic acid, fumaric acid, adipic acid, linoleic acid dimer, malonic acid, alkyl malonic acids, alkenyl malonic acids) with a variety of alcohols (e.g., butyl alcohol, hexyl alcohol, dodecyl alcohol, 2-ethylhexyl alcohol, ethylene glycol, diethylene glycol monoether, propylene glycol). Specific examples of these esters include dibutyl adipate, di(2-ethylhexyl) sebacate, di-n-hexyl fumarate, dioctyl sebacate, diisoctyl azelate, diisodecyl azelate, dioctyl phthalate, didecyl phthalate, dieicosyl sebacate, the 2-ethylhexyl diester of linoleic acid dimer, and the complex ester formed by reacting one mole of sebacic acid with two moles of tetraethylene glycol and two moles of 2-ethyl-hexanoic acid.

Esters useful as synthetic oils also include those made from $C_5$ to $C_{12}$ monocarboxylic acids and polyols and polyol ether such as neopentyl glycol, trimethylolpropane, pentaerythritol, dipentaerythritol and tripentaerythritol.

The metalworking fluids ready for use should contain 1 wt % to 20 wt % of the petroleum oxidate component, and 1 wt % to 20 wt % of the overbased calcium sulfonate component.

Concentrates are also useful, containing higher amounts of each of these two components (in the indicated ratio to each other). For instance, a useful concentrate would comprise up to 20 wt % to 90 wt % of each component with the balance (if any) comprising lubricating oil as described herein. Concentrates lessen storage and transportation costs and let the user formulate a metalworking fluid at the point of use by mixing the concentrate with an appropriate amount of lubricating oil. Typical dilution factors could be 1:1 up to 1:20 or even 1:40 (concentrate:lubricating oil).

The effectiveness of the compositions and methods of the present invention are demonstrated in the following section. The effect of calcium overbased sulfonate in combination with petroleum oxidate, on drawing of electrogalvanized steel sheets was evaluated by a Draw Bead Simulation Test developed by H. D. Nine or R. Allemang.

Lubricity performance by Falex Test was evaluated according to ASTM procedure D3233, Test Method A with Steel SAE 3135 (pin) and Steel AISI 137 (v-block). Humidity Cabinet Test, ASTM procedure D1748 and the Cleveland Cabinet Test, ASTM D4585 were used for corrosion study.

Particle size was measured using Nicomp Model 370 DLS (dynamic light scattering) with HeNe laser system at 5–10% in heptane. Compatibility of calcium overbased sulfonate and petroleum oxidate was studied using an equal amount of calcium sulfonates and various oxidates. Low viscosity paraffinic oil (80%) was added to facilitate observation of any reaction, sedimentation or separation. The samples were examined weekly during a period of 16 weeks for gellation, precipitation and sedimentation.

Drawability performance was evaluated by Draw Bead Test using stamping Lubricant Tester designed by the Stamping Lubricant Testing, Inc. The test entails coating the dies and a standardized test strip with the candidate drawing compound, clamping the strip in the coated dies, and pulling the strip through the dies for a distance of 5". Loads experienced while pulling the strip through the dies are recorded against the instantaneous travel through the use of an X-Y recorder. Specific points are picked on the curve and an SLT (Stamping Lubrication Test) value is determined. The SLT value relates the candidate drawing compound performance to a 1200 second viscosity oil, which is the standard and is tested with every batch of candidate compounds.

The machine is a horizontal simulated fixed draw bead tester mounted on an integral bench with casters for easy movement. The test pulls a 2"×18"×0.030" metal strip horizontally with a maximum force of 10,000 lbs. and pull rate 160 in./min. with 1000 lbs. hold down pressure. Electrogalvanized steel, two sided, EG 70/70,0.0300" was used for testing. Mixtures of various petroleum oxidate and calcium overbased sulfonate were evaluated at 10% level (5+5%) in 100 SUS (100° F.) paraffinic oil or other substrates as specified.

The oxidates tested were preferably compatible with calcium overbased sulfonate in amorphous form. Bright and clear samples with no or minimum precipitation were selected. Previous work has suggested that chemical reactions can occur between overbased sulfonate and other additives which usually impair performance. Light sediment or slight haze was occasionally observed with calcium overbased sulfonate in crystalline form. Any tendency for inorganic calcium compounds which are present along with calcium sulfonate, to react with free fatty acids of oxidate was also evaluated. Viscosity change, gellation or heavy precipitation did not occur with the oxidates selected for this study. The reactivity with the oxidates was not directly related to acid number, but material which had larger amounts of low molecular weight acids was most reactive with the overbased sulfonate. Overbased calcium sulfonate with minimum strong TBN present was the least reactive among the sulfonates. To minimize interaction, the oxidates used should have low acid numbers and should have been processed to remove most low molecular weight acids.

On the basis of compatibility, calcium overbased sulfonate and various petroleum oxidates were selected for evaluation for lubricity by Falex Test and corrosion protection using humidity cabinet. Lubricity evaluation by Falex Test revealed that failure loads are moderate 1100–1300 lbs.) and all were characterized as weld type of failure. These results indicate some possible interaction which is preventing the anti-weld interaction normally seen with the overbased sulfonate. Typical failure load for 5% solution of calcium overbased sulfonate in crystalline form in 100 SUS (100° F) paraffinic oil is 4500 lbs. steel on steel while for amorphous calcium overbased sulfonate is 2150 lbs.

Evaluation of corrosion protection by Humidity Cabinet and the Cleveland Cabinet Test indicates that the various mixtures of petroleum oxidate and calcium overbased sulfonate have similar corrosion resistance (20–37 days to fail) to the petroleum oxidates when they were evaluated alone at the same concentration in oil solutions.

Materials which showed acceptable chemical compatibility and corrosion protection were selected for further lubricity evaluation by the Draw Bead Simulation Test. The latter is most widely accepted in the automotive industry and it appears to be a useful tool for the investigation of the effects of various boundary lubricant additives for metal drawing.

A low viscosity (100SUS at 100° F.) paraffinic oil was used for the initial stage of the investigation. This oil was selected to minimize the effect of oil viscosity on drawability. Low viscosity drawing oil may be desirable due to better handling and cleaning behavior.

The drawing test failed and the metal strip was snapped when the crystalline calcium overbased sulfonate used. The latter has a larger particle size compared to the amorphous calcium sulfonate. The various oxidates along with amorphous calcium overbased sulfonate (5+5% in 100 SUS paraffinic oil) exhibit good drawability with Stamping Lubrication Test (SLT) value in range of 212–225 which is slightly higher than sulfonate alone.

The combinations of amorphous calcium overbased sulfonate with oxidate were also evaluated by Draw Bead Test in the different viscosity paraffinic oil. Lubricity performance was improved as expected (Stamping Lubrication value was decreased) with the higher viscosity oil. The results are presented in Table A.

TABLE A

| Oil Viscosity, at 100° F. | SLT Value | Viscosity of Calcium Sulfonate (5%) and Oxidate (5%) in oil, at 100° F. | SLT Value |
|---|---|---|---|
| 125 SUS | Fail | 125 SUS | 228 |
| 377 SUS | 155 | 331 SUS | 134 |
| 490 SUS | 105 | 510 SUS | 111 |

Chlorinated hydrocarbon with 56% chlorine (10% solution in oil), a combination of amorphous overbased calcium sulfonate (free of Calcium hydroxide) with oxidate (5 and 5% solution in oil) and paraffinic oil with similar viscosity were evaluated by Draw Bead Test. Stamping Lubricity Test values are 130. 7,134.9 and 155.4 respectively for compounds mentioned above. The results are presented in Table B.

TABLE B

| Viscosity, 100° F. | Compounds | SLT Values |
|---|---|---|
| 352 SUS | Chlorinated hydrocarbons (56% Chlorine) | 130.7 |
| 331 SUS | Calcium Sulfonate and Oxidate (5 + 5% solution in oil) | 134.9 |
| 377 SUS | Paraffinic Oil | 155.4 |

This result demonstrates that calcium overbased sulfonates combined with petroleum oxidate are effective lubricants for drawing electrogalvanized steel. Their lubricity performance is comparable to chlorinated hydrocarbons.

Lubricity performance by the Draw Bead Test did not substantially change when the ratio of calcium sulfonate to oxidate was increased from 50/50 to 75/25. SLT values were 134.9 and 147.6 respectively when both samples were evaluated as 10% solution in 377 SUS viscosity paraffinic oil. Changing the concentration of both calcium overbased sulfonate and oxidate in 100 SUS paraffinic oil from 10% (5 and 5%) to 5% (2.5 and 2.5%) had a negligible effect on SLT values (257.9 and 248.1 respectively).

Neutral calcium overbased sulfonate with a low TBN (20–50) showed poor drawability. It appears, particles of calcium carbonate in high TBN calcium overbased sulfonate are trapped between two surfaces and seem able to prevent direct metal to metal contact.

What is claimed is:

1. An oil-soluble non-gelling composition of matter comprising (a) petroleum oxidate comprising the product that is produced by oxidizing petroleum feed material with an oxidizing agent and having a total acid number no greater than 35; and (b) overbased calcium sulfonate having a total base number of at least about 150 and a strong total base number less than 10;

wherein the weight ratio of component (a) to component (b) is 10:1 to 1:10 wherein said composition of matter is free of, or contains no more than trace amounts of, carboxylic acids containing 8 or fewer carbon atoms.

2. The composition of matter of claim 1 wherein said petroleum oxidate has a total acid number no greater than 20.

3. The composition of matter of claim 1 wherein said component (a) and said component (b) are each present in amounts of about 1 to 20 wt % of said composition of matter.

4. The composition of matter of claim 1 wherein said overbased calcium sulfonate has a total base number of at least 200.

5. The composition of matter of claim 1 wherein said overbased calcium sulfonate has a total base number up to 500.

6. The composition of matter of claim 1 wherein said overbased calcium sulfonate is amorphous.

7. The composition of matter of claim 1 wherein said overbased calcium sulfonate has a strong total base number less than 5.

8. An oil-soluble non-gelling composition of matter which is the product formed by combining (a) petroleum oxidate comprising the product that is produced by oxidizing petroleum feed material with an oxidizing agent and having a total acid number no greater than 35 and free of, or containing no more than trace amounts of, carboxylic acids containing 8 or fewer carbon atoms; and (b) overbased calcium sulfonate having a total base number of at least 150, a strong total base number less than 10, and free of, or containing no more than trace amounts of, calcium hydroxide.

9. The composition of matter of claim 8 wherein said petroleum oxidate has a total acid number no greater than 20.

10. The composition of matter of claim 8 wherein said overbased calcium sulfonate has a total base number of at least 200.

11. The composition of matter of claim 8 wherein said overbased calcium sulfonate has a total base number up to 500.

12. The composition of matter of claim 8 wherein said overbased calcium sulfonate is amorphous.

13. The composition of matter of claim 8 wherein said overbased calcium sulfonate has a strong total base number less than 5.

14. A lubricating composition comprising a lubricating oil or grease and an oil-soluble non-gelling composition of matter which contains (a) petroleum oxidate comprising the product that is produced by oxidizing petroleum feed material with an oxidizing agent and having a total acid number no greater than 35, and (b) overbased calcium sulfonate having a total base number of at least 150 and a strong total base number less than 10; which composition of matter is free of, or contains no more than trace amounts of, carboxylic acids containing 8 or fewer carbon atoms; and is free of, or contains no more than trace amounts of, calcium hydroxide, wherein the weight ratio of component (a) to component (b) is 10:1 to 1:10.

15. The composition of matter of claim 14 wherein said petroleum oxidate has a total acid number no greater than 20.

16. The composition of matter of claim 14 wherein said component (a) and said component (b) are each present in amounts of about 1 to 20 wt % of said composition of matter.

17. The composition of matter of claim 14 wherein said overbased calcium sulfonate has a total base number of at least 200.

18. The composition of matter of claim 14 wherein said overbased calcium sulfonate has a total base number up to 500.

19. The composition of matter of claim 14 wherein said overbased calcium sulfonate is amorphous.

20. The composition of matter of claim 14 wherein said overbased calcium sulfonate has a strong total base number less than 5.

21. A method of forming an oil-soluble non-gelling fluid useful as a lubricating composition, comprising the steps of combining (a) petroleum oxidate comprising the product that is produced by oxidizing petroleum feed material with an oxidizing agent and having a total acid number no greater than 35 and free of, or containing no more than trace amounts of, carboxylic acids containing 8 or fewer carbon atoms; and (b) overbased calcium sulfonate having a total base number of at least 200 and a strong base number less than 10 and free of, or containing no more than trace amounts of, calcium hydroxide, in amounts such that the weight ratio of component (a) to component (b) is 10:1 to 1:10.

22. The method of claim 21 wherein said petroleum oxidate has a total acid number no greater than 20.

23. The method of claim 21 wherein said overbased calcium sulfonate has a total base number of at least 200.

24. The method of claim 21 wherein said overbased calcium sulfonate has a total base number up to 500.

25. The method of claim 21 wherein said overbased calcium sulfonate is amorphous.

26. The method of claim 21 wherein said overbased calcium sulfonate has a strong total base number less than 5.

27. A method of forming a fluid useful as a lubricating composition, comprising combining a lubricating oil and 1 wt % to 20 wt % of a fluid prepared in accordance with the method of claim 21.

28. A method of forming a fluid useful as a lubricating composition, comprising combining a lubricating oil and 1 wt % to 20 wt % of a fluid prepared in accordance with the method of claim 22.

29. A method of forming a fluid useful as a lubricating composition, comprising combining a lubricating oil and 1 wt % to 20 wt % of a fluid prepared in accordance with the method of claim 23.

30. A method of forming a fluid useful as a lubricating composition, comprising combining a lubricating oil and 1 wt % to 20 wt % of a fluid prepared in accordance with the method of claim 24.

31. A method of forming a fluid useful as a lubricating composition, comprising combining a lubricating oil and 1 wt % to 20 wt % of a fluid prepared in accordance with the method of claim 25.

32. A method of forming a fluid useful as a lubricating composition, comprising combining a lubricating oil and 1 wt % to 20 wt % of a fluid prepared in accordance with the method of claim 26.

33. A method of lubricating metal during working thereof, comprising applying to said metal a fluid comprising an effective amount of (a) petroleum oxidate comprising the product that is produced by oxidizing petroleum feed material with an oxidizing agent and having a total acid number less than 35; and (b) overbased calcium sulfonate having a total base number of at least 150 and a strong total base number less than 10; wherein the weight ratio of component (a) to component (b) is 10:1 to 1:10; and wherein said fluid is free of, or contains no more than trace amounts of carboxylic acids containing 8 or fewer carbon atoms, and is free of, or contains no more than trace amounts of, calcium hydroxide.

34. The composition of matter of claim 33 wherein said petroleum oxidate has a total acid number no greater than 20.

35. The composition of matter of claim 33 wherein said component (a) and said component (b) are each present in amounts of about 1 to 20 wt % of said composition of matter.

36. The composition of matter of claim 33 wherein said overbased calcium sulfonate has a total base number of at least 200.

37. The composition of matter of claim 33 wherein said overbased calcium sulfonate has a total base number up to 500.

38. The composition of matter of claim 33 wherein said overbased calcium sulfonate is amorphous.

39. The composition of matter of claim 33 wherein said overbased calcium sulfonate has a strong total base number less than 5.

* * * * *